United States Patent [19]

Bickford

[11] 4,042,803

[45] Aug. 16, 1977

[54] BODY HEATING AND STRETCH SUPPORT DEVICE

[75] Inventor: Edgar P. Bickford, Danbury, Conn.

[73] Assignee: The Raymond Lee Organization, Inc., New York, N.Y. ; a part interest

[21] Appl. No.: 653,138

[22] Filed: Jan. 28, 1976

[51] Int. Cl.[2] ..... H05B 1/00

[52] U.S. Cl. ..... 219/211; 128/379; 219/527; 219/529

[58] Field of Search ..... 219/211, 527–529; 128/379, 380, 381, 384, 385, 402

[56] References Cited

U.S. PATENT DOCUMENTS

| | | | |
|---|---|---|---|
| 2,298,298 | 10/1942 | Joy et al. | 219/211 |
| 2,617,916 | 11/1952 | Neidnig | 219/527 |
| 2,842,655 | 7/1958 | Schwebel | 219/527 |
| 3,084,241 | 4/1963 | Carrona | 219/211 |
| 3,178,559 | 4/1965 | Fogel et al. | 219/211 X |
| 3,249,108 | 5/1966 | Terman | 219/529 X |
| 3,680,563 | 8/1972 | Forrest | 219/527 X |
| 3,858,028 | 12/1974 | Kerr | 219/211 |

*Primary Examiner*—C. L. Albritton
*Attorney, Agent, or Firm*—Daniel Jay Tick

[57] ABSTRACT

A sheet of material is adapted to be supported on a part of a human body in contact therewith and has adjusting devices for adjusting the size thereof to fit different sized people. Electric heating elements are embedded in the stretch support material. An energizing device releasably electrically connects the heating elements to a source of electrical energy for selectively heating the part of the body contacted by said sheet of material.

2 Claims, 5 Drawing Figures

BODY HEATING AND STRETCH SUPPORT DEVICE

DESCRIPTION OF THE INVENTION

The present invention relates to a body heating device.

Objects of the invention are to provide a body heating device of simple structure, which is inexpensive in manufacture, used with facility, convenience and complete safety, and functions efficiently, effectively and reliably to heat any desired part or parts of a human body for reasons of comfort or therapy such as, for example, relieving the discomforts of arthritis, muscle strain, sprains, and so on. In order that the invention may be readily carried into effect, it will now be described with reference to the accompanying drawing, wherein.

Figure 5:
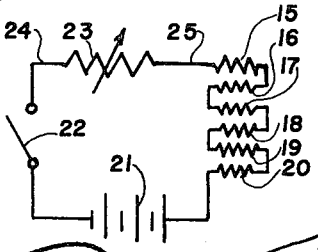
Figure 3:
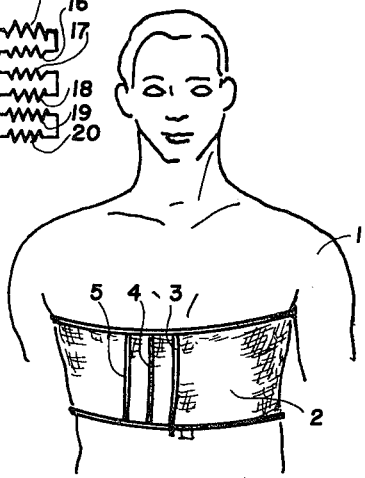
FIG. 3 is a view of the body heating device of FIG. 2 in use on the body of a user.
Figure 4:
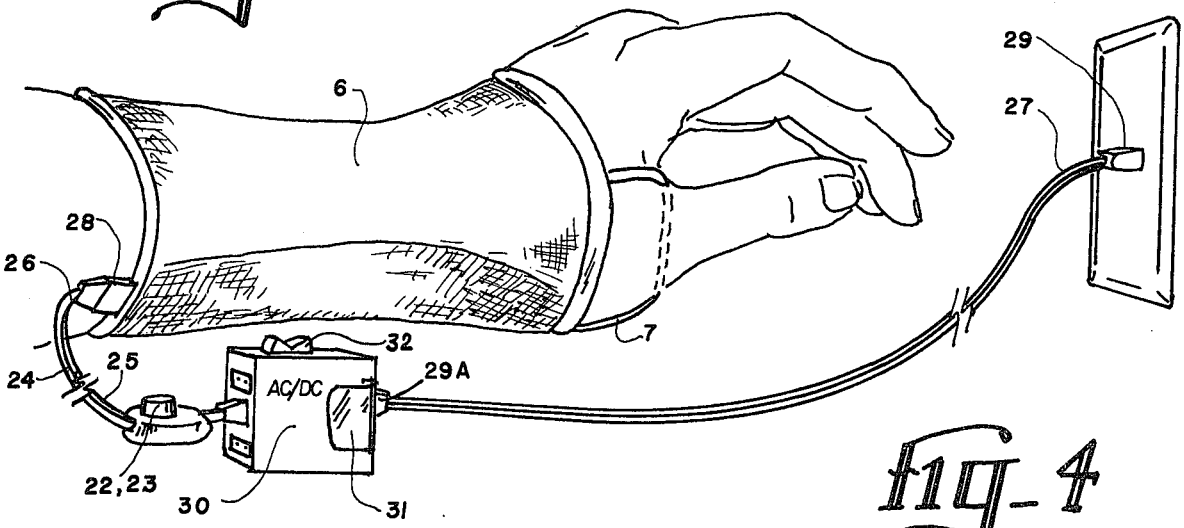

FIG. 4 is a perspective view of a body heating device of the invention in use on the body of a wearer; and FIG. 5 is a circuit diagram of the body heating device of the invention. The body heating device of the invention comprises a sheet of material adapted to be supported on a part of a human body 1 (FIGS. 1 and 3) in contact therewith. The sheet of material includes adjusting means for adjusting the size thereof to fit different sized people. The material may comprise any suitable material such as, for example, that commonly used for electric heating pads. The sheet of material is preferably a generally elongated rectangular strip, but may comprise any desired configuration in order to fit a desired part of the body.

The adjusting means of the sheet of material may comprise an elastic band forming an integral part of the material, and the material itself preferably has a specified elasticity and resiliency. Adjusting means may comprise a plurality of zippers for fastening selected segments of the sheet of material to each other. Thus, a sheet of material 2 (FIGS. 1 to 3) may be affixed around the torso of the body 1 (FIGS. 1 and 2) via a zipper 3. In order to permit the material to be fitted on different sized people, additional zippers 4 and 5 (FIGS. 1 to 3) are provided in the material in parallel with the zipper 3, so that the material may be fitted on different sized waists.

A sheet of material 6 (FIGS. 1 and 4) of the same general configuration as the sheet of material 2, which is a generally elongated rectangular strip, is affixed around a wrist or forearm of the body 1 of the user. A loop 7 (FIGS. 1 and 4) extends from the material and is adapted to fit around the thumb of the hand of the user to maintain the material in position. The material may also be in the configuration of a sleeve, in which case it may be fitted over the hand onto the arm in the same manner as an opera glove.

Figure 1:
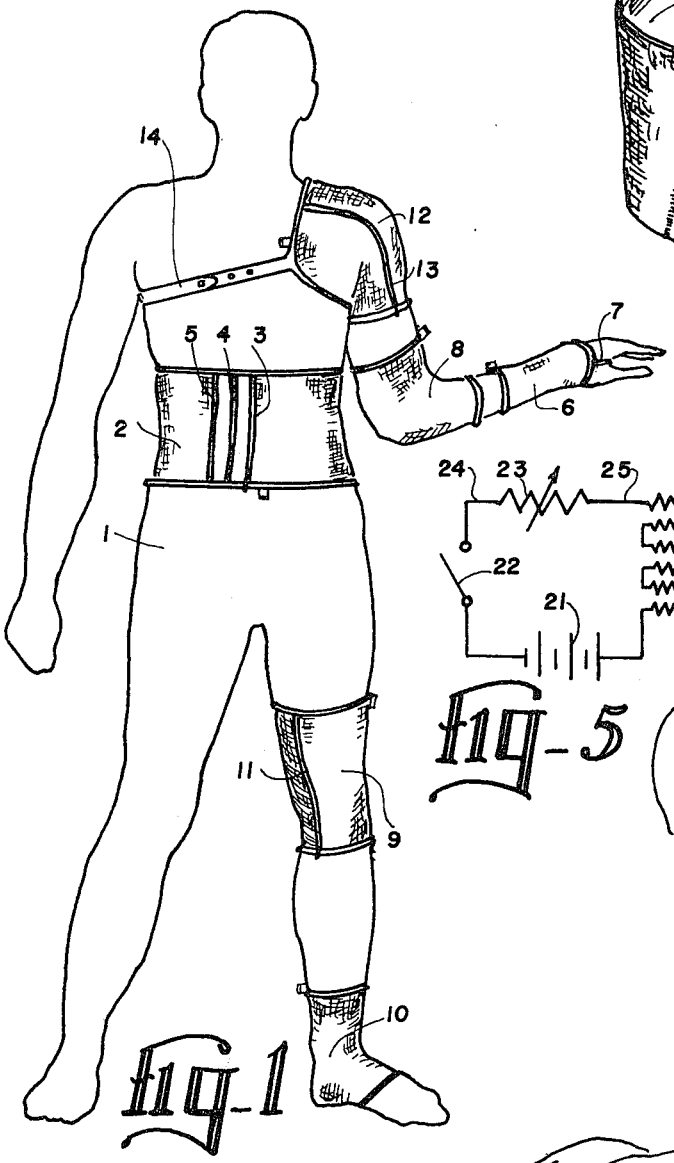
FIG. 1 is a view of the body heating device of the invention on different parts of the body of a user.
Figure 2:
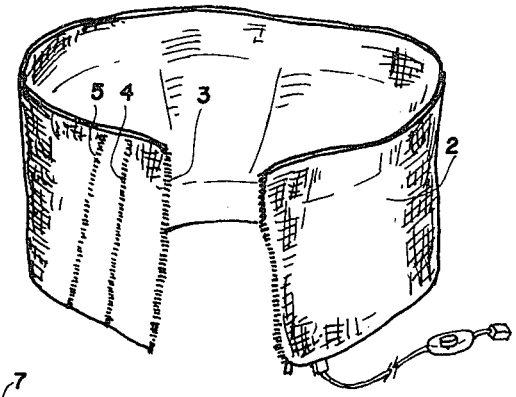
FIG. 2 is a perspective view, on an enlarged scale, of a body heating device of the invention.

A sheet of material 8 is mounted on the elbow of the user (FIG. 1). A sheet of material 9 is mounted on the knee of the user (FIG. 1). A sheet of material 10 is mounted on the ankle of the body of the user (FIG. 1). Each of the sheets of material 8, 9 and 10, is the same as the sheets hereinbefore described and each may have a rectangular strip type configuration or may be of sleeve type configuration as hereinbefore described. Thus, as shown in FIG. 1, the sheet 9 is secured by a zipper 11.

A sheet of material 12 is maintained on a shoulder of the body 1 of the user, as shown in FIG. 1. The sheet may include a zipper 13, or a plurality of zippers, in order to adjust its size, and is held on the shoulder by a strip 14 which passes across the chest and back of the user and under his other arm.

Electric heating elements 15, 16, 17, 18, 19 and 20, as shown in FIG. 5, are embedded in the sheet of material 2, 6, 8, 9, 10 and 12 in the same manner as a heating pad.

An energizing device releasably electrically connects the heating elements to a source of electrical energy 21 of any suitable type such as, for example, a battery or batteries of any suitable type, which is preferably rechargeable (FIG. 5) for selectively heating the part of the body contacted by the sheet of material. The energizing device includes an electric ON-OFF switch 22 (FIG. 5) and an electric resistance device 23 for providing a variable resistance to electric current (FIG. 5). Electrically conductive connectors 24 and 25 (FIGS. 4 and 5) connect the switch 22 and the electric resistance device 23 in series and have spaced opposite ends 26 and 27, as shown in FIG. 4. A pair of electrical connector plugs 29 and 29A are provided. A plug 28 is connected to the end 26 of the electrical connectors for making electrical contact with the heating elements 15 to 20 and the plug 29 is connected to the end 27 of the conductors for making electrical contact with the source of electrical energy 21 which may be a commercial power source, as indicated in FIG. 4, rather than a rechargeable battery, as indicated in FIG. 5.

The energizing device includes a housing 30 (FIG. 4) having a clip or hook type fastener 31 affixed to and extending therefrom for removably affixing it to clothing such as, for example, a belt or pocket flap, of the user. Electrical power supply means of any suitable type are provided in the housing 30 and may comprise a rechargeable battery, as hereinbefore mentioned, or a transformer system for adapting the heating elements to a commercial source of electrical energy.

The energizing device includes an AC/DC switch 32 (FIG. 4).

The zippers 3, 4 and 5 may be replaced by an adhesive strap of approximately 8 to 12 inches for adjustable sizes and for holding the device in position.

The energizing device may energize more than one heating element device by having multiple sockets.

While the invention has been described by means of a specific example and in a specific embodiment, I do not wish to be limited thereto, for obvious modifications will occur to those skilled in the art without departing from the spirit and scope of the invention.

I claim:

1. A body heating and stretch support device, comprising a sheet of stretch support material adapted to be supported on a part of a human body in contact therewith, said sheet of material having an elastic band for adjusting the size thereof to fit different sized people and a plurality of zippers for fastening selected segments of the sheet to each other;

electric heating means embedded in the material; and energizing means for releasably electrically connecting the heating means to a source of electrical energy for selectively heating the part of the body contacted by the sheet of material, said energizing means including electric switch means, electric resistance means, electrically conductive means connecting the switch means and resistance means in series, said conductive means having spaced opposite ends, a housing having fastening means thereon for removably affixing it to clothing of a user, electric power supply means in the housing, and a pair of electrical connector plugs each connected to a corresponding end of the conductive means for making electrical contact with the heating means and with a source of electrical energy via the power supply means and an AC/DC switch in the housing for connection to either an AC or a DC source of electrical energy.

2. A body heating device as claimed in claim 1, wherein the power supply means comprises rechargeable battery means.

* * * * *